US005095827A

United States Patent [19]

Williams

[11] Patent Number: 5,095,827

[45] Date of Patent: Mar. 17, 1992

[54] APPARATUS FOR REDUCING THE MOISTURE CONTENT IN COMBUSTIBLE MATERIAL BY UTILIZING THE HEAT FROM COMBUSTION OF SUCH MATERIAL

[76] Inventor: Robert M. Williams, 16 La Hacienda, St. Louis, Mo. 63124

[21] Appl. No.: 664,638

[22] Filed: Mar. 5, 1991

[51] Int. Cl.[5] ..... F23B 7/00

[52] U.S. Cl. ..... 110/234; 110/232; 110/347

[58] Field of Search ..... 110/232, 347, 345, 234, 110/346

[56] References Cited

U.S. PATENT DOCUMENTS

| | | | |
|---|---|---|---|
| 4,640,204 | 2/1987 | Williams | 110/232 X |
| 4,831,942 | 5/1989 | Morimoto et al. | 110/342 X |
| 4,998,485 | 3/1991 | Williams | 110/232 X |

*Primary Examiner*—Edward G. Favors
*Attorney, Agent, or Firm*—Gravely, Lieder & Woodruff

[57] ABSTRACT

Apparatus for preparing in a circulating fluid bed boiler fuel material that is fed to the boiler with a moisture content that is normally high enough to plug grinding apparatus needed to grind the fuel material to a particulate size for combustion, operating the boiler and grinding apparatus in cooperation so that heat energy at a high temperature is borrowed from the boiler for drying the fuel material at the grinding apparatus and returning the heat energy in the form of steam so there is no net loss of heat energy. The system provides that hot gases discharged from the boiler are fed into the grinding apparatus for drying the incoming moisture containing fuel material before it is conveyed to the boiler as a fuel, and controlling the boiler and grinding apparatus, with or without sorbent, so that the boiler fuel demand is independent of the quantity of fuel material in the grinding apparatus and the rate of grinding of the fuel material is maintained at a predetermined pressure differential in the grinding apparatus.

4 Claims, 2 Drawing Sheets

APPARATUS FOR REDUCING THE MOISTURE CONTENT IN COMBUSTIBLE MATERIAL BY UTILIZING THE HEAT FROM COMBUSTION OF SUCH MATERIAL

BACKGROUND OF THE INVENTION

1. Field of the Invention

This invention is directed to a method of reducing the moisture content level in waste material by utilizing the combustion gases produced by the combustion of waste material to reduce the moisture content during the preparation of the moisture bearing material for grinding, and to provide an inert atmosphere during the drying and grinding process.

2. Description of the Prior Art

The problem in connection with prior attempts to burn moisture bearing material is that the wetness or moisture content of such material needs to be greatly reduced so it will be amendable to grinding to a size that will be suitable for feeding to a circulating fluid bed combustor (CFB). In some waste material, the moisture content can be as much as about 15 percent. This is the situation found in a mixture of coal containing clay, slate and other particulate. That mixture when it contains up to fifteen percent free moisture will plug mills used to grind the solids. However, when the material has its moisture content lowered to a state of about six percent, it can be utilized in a furnace. Another class of waste material called sludge usually has a moisture content of 60 to 70 percent and usually is a mixture of paper and wood with moisture up to 70 percent. That class of material will plug a mill when attempting to grind the mass in order to reduce the solids to a burnable particulate size.

The drying step is expensive and requires additional equipment. This fact introduces a problem of handling moisture bearing fuel material so it will be amendable to grinding to a particle size that will be suitable for feeding to a circulating fluid bed combustor. There is a further problem in that the grinding of wet material causes a condition of rapid wear to apparatus that is expensive to replace.

When a drying step is employed using an external source of heat energy such as gas or oil, that heat source must be properly cleaned so as to meet local and state environmental standards with a resultant loss of energy that needs to be used to evaporate the moisture.

SUMMARY OF THE INVENTION

It has been found that moisture bearing waste material, if substantially dried and reduced in particle size, can be used as the fuel to generate the necessary heat energy for commercial purposes, as well as to effectively pre-dry the waste material so that the grinding of the waste material can be successfully carried on without plugging the mill which is used to grind the waste material. It has also been found that the grinding of the waste material needs to be carried on in an inert or low oxygen content atmosphere so that if sparks ar struck from hard particulate during the grinding process internal combustion in the grinding mill will not start.

The important object of the invention is to provide an inert and negative pressure circulating system between a circulating fluid bed combustion boiler and a grinding mill so that sufficient heat generated by combustion of waste material can be applied to the grinding apparatus to effect the reduction of the moisture in the waste material so the grinding thereof will not plug and there will be no necessity to use heat energy generated externally of the system.

The objects of the invention are to employ combustion heat energy to dry and render the moisture bearing material inert to spontaneous combustion during the grinding thereof, and to borrow the hot gases from combustion of the resulting ground material for drying and inerting the grinding apparatus before feeding the ground material to a furnace or boiler.

It is an object of the invention to use hot gases from a circulating fluid bed combustion so the heat energy can dry the material and return the evaporated moisture to the furnace or boiler, whereby no continuing external heat source is needed after the apparatus has attained operating temperature.

A further object of the invention is to provide a system for supplying fuel from a source of moisture bearing material to a multiple distribution apparatus from an inert and drying atmosphere by extracting heat energy from the boiler that is supplied from the distribution apparatus with ground fuel and applying that heat energy for drying the incoming fuel during the grinding operations and circulating the heat energy in a closed system which includes the grinding apparatus and the apparatus which extracts the ground fuel from the circulating heat so that residual heat can be returned to the grinding apparatus.

It is also an important object in the operation of a circulating fluid bed combustor to prestrip the fines from the fuel entering the grinding mill to avoid over grinding and also to subject the fuel to a sufficient temperature level to dry the fuel material which needs to be ground before use as well as that which is already of a size suitable for use in a furnace or boiler.

A further object of the invention is to feed coal and a limestone sorbent to a circulating fluid bed combustor by joining the coal and a limestone sorbent through grinding apparatus and to regulate the coal and limestone so as to convert the discharge at the combustor stack to carbon dioxide into the atmosphere.

Yet another object of the invention is concerned with providing an outlet from the mill for the hard to grind components, and to subject such components to a beneficiation step so the fines are separated and moved to the boiler while the hard components are moved out of the apparatus, or are recycled.

Other objects will be set forth in the following description.

DETAILED DESCRIPTION OF THE DRAWINGS

Figure 1:
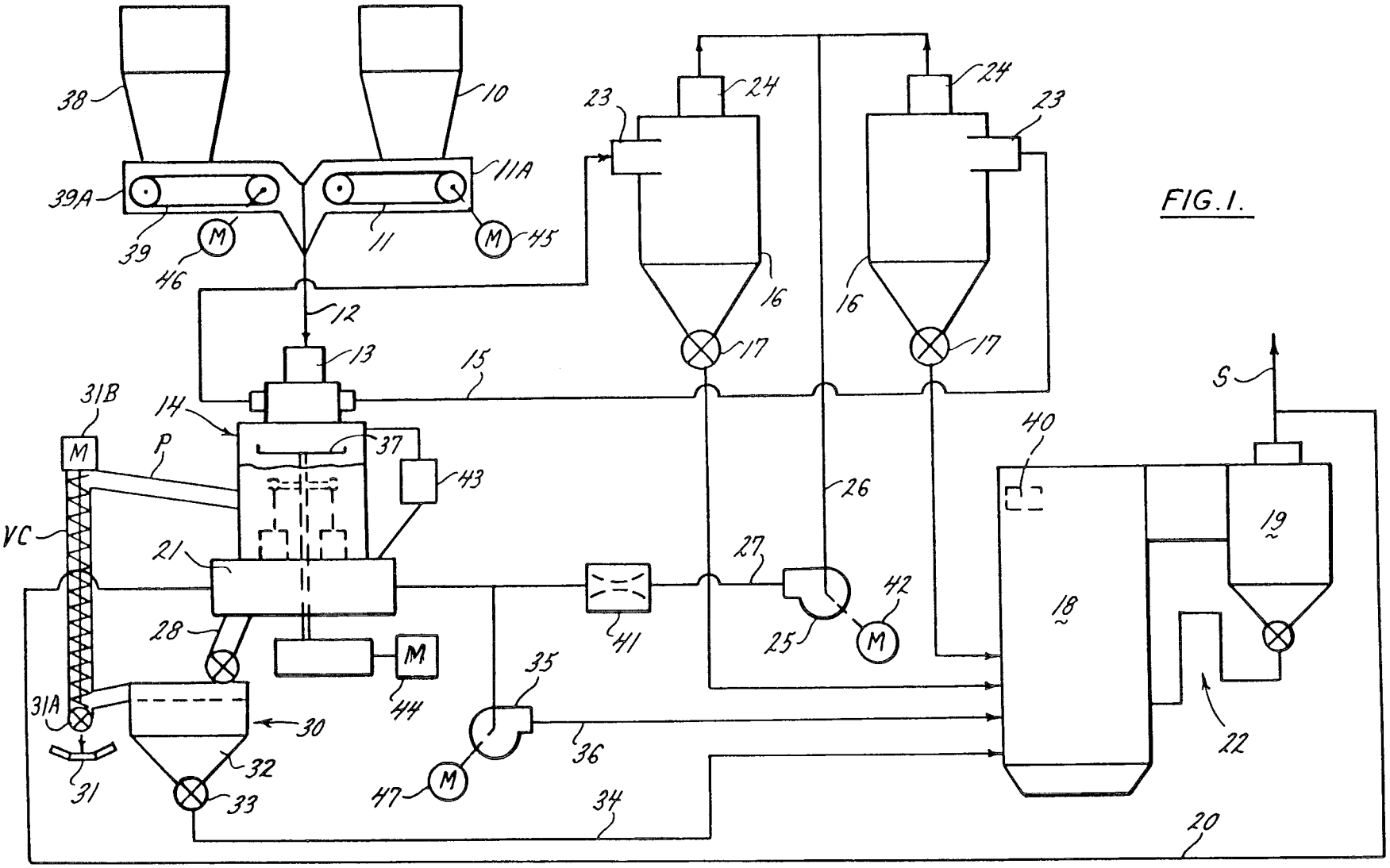
Figure 2:
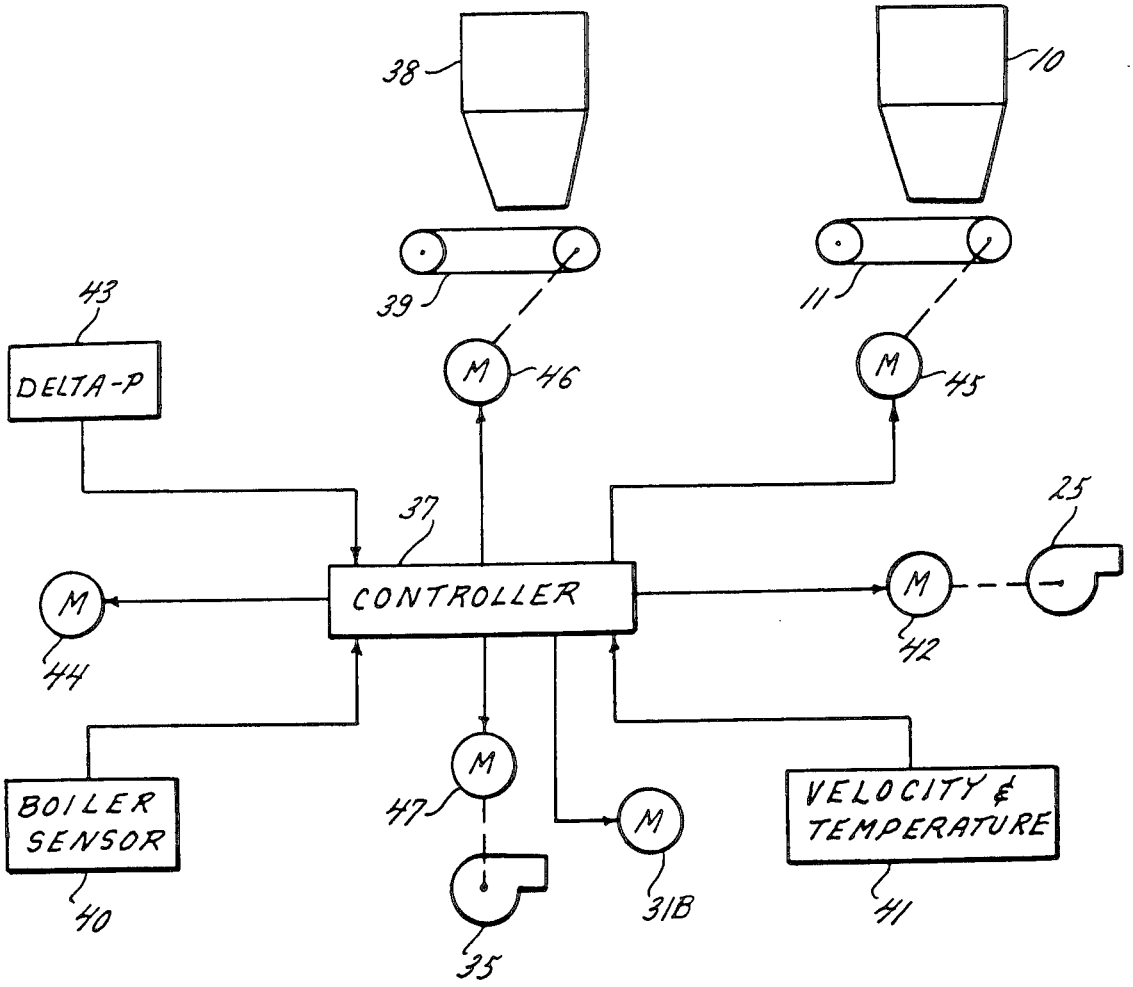

The invention is believed best illustrated in the following drawing in which:

FIG. 1 is a schematic diagram of apparatus that embodies the subject matter of the invention; and FIG. 2 is a schematic diagram of a suitable control arrangement for the apparatus.

DETAILED DESCRIPTION OF THE INVENTION

The burning of moisture bearing waste material, which is usually wet and sticky, has presented a problem in effecting its ability to be used as a fuel to recover its heat energy. The problem is that the material needs to be ground to a size suitable for burning, and the moisture content needs to be lowered to an extent sufficient for proper grinding as well as combustion. The present invention provides apparatus to process the material for its fuel value, whereby a sufficient portion of the heat of combustion will supply the energy to sufficiently dry the incoming material for grinding while avoiding plugging grinding apparatus.

In the drawing the incoming material is collected in a bin 10, and is moved to feeder conveyor 11 in an enclosure 11A that excludes air but delivers it to conduit 12 connected to the inlet fitting 13 of a roller mill 14, although other types of mills can be used. The mill delivers ground material to a conduit 15 for delivery to one or more cyclone separators 16 which represent a multiple distribution arrangement. At the cyclones 16, the fines, after being separated from the gaseous medium, are collected and pass through gates 17 to conduit means for delivery to the furnace or boiler 18 by gravity feed. In this connection, the furnace or boiler may need only one supply connection at the fitting 13. If a multiple distribution supply is required, each supply will have its own connection to fitting 13 so each supply will be substantially uniform as to quantity.

The cyclones operate to remove the gaseous medium and return it via conduit 26 and blower 25 to the bustle 21 at the mill 14. In order to maintain the first circuit between the mill 14 and the cyclones 16 at a negative pressure, a blower 35 is connected into conduit 27 to exert a sufficient negative pressure on that first circuit established through the boiler 18 and back to the bustle 21 at the mill 14 through conduit 20. It is seen that the combustion that occurs in the boiler 18 produces moist hot gases which are moved to a cyclone 19 to extract residual fines from the hot gaseous vapor. A portion of the hot gaseous vapor flows back through conduit 20 to enter the inlet bustle 21 at the mill 14 to dry the incoming material in the mill. The fines separated from the hot gases in cyclone 19 are returned through loop seal 22 to the Boiler 18.

The gases, ground material and hot vapors which are discharged from the mill 14 into conduit 15 are received at the inlet 23 of each cyclone 16 and the ground material is separated and retained for delivery at gates 17, while the gases are recovered at the outlet 24 of each cyclone 16 through the operation of blower 25 in a common return conduit 26. The blower output conduit 27 is connected into the bustle 21 at the mill 14. Any hard to grind solids are released from the mill 14 at the discharge 28 through rotary gate 29 associated with an enclosed screen device 30 which beneficiates the fines by separating the hard to grind content of the material and deliver it through a gate 31A to a take away conveyor means 31 or to an enclosed vertical conveying device VC to a top outlet at a closed gravity feed pipe P which directs the material inot the grinder 14. The fine material screened out at device 30 falls into the collector 32 which is released at gate 33 for conveyance by conduit 34 to the boiler 18.

In the drawing, a first or main circulating gas loop created by the blower 25 draws the fine material and gaseous vapors from the mill 14 by the suction effect at the cyclones 16 through conduit 26 and returns the gases by conduit 27 to the mill bustle 21. A second circulation loop is created by the blower 35 which draws a negative pressure by the gases withdrawn from conduit 27 and force the gases through conduit 36 to the Boiler 18 where the gases are heated to the order of substantially 1,600° F. The heated gases or vapor, recovered from the boiler 18 by the cyclone 19, is returned to the mill by conduit 20 to dry the waste material in the mill 14.

In the system depicted in the drawing of FIG. 1, the waste material from the bin 10 is ground in the mill in a hot gas atmosphere (after the start up using external fuel) received from the Boiler 18 through conduit 20 at about 1,600° F. which renders it inert due to the oxygen content being reduced to the level of six to eight percent while the moisture content of the material is reduced to six percent or less. With the inert gas and ground material moving in the first or main circuit there is no problem with spontaneous combustion from the grinding action in the mill 14. The moisture can enter the system by the moisture in the raw fuel. It is evaporated and the moisture is conveyed through the cyclone means 16 and then a portion thereof is exhausted from the first circuit to the boiler 18 in the second circuit subject to the effect of blower 35.

The system operates without substantial loss of heat energy due to the recirculation of the heat from boiler 18 to the mill 14 which dries and prepares the waste material to be ground to a fineness of the order of particles having an average size of 50 percent passing 700 microns. It can be appreciated that the heat energy generated by the boiler 18 is used to dry the incoming fuel material and then returned to the boiler. The only heat loss is by radiation.

The foregoing disclosure possesses certain innovative features which accomplish several important improvements. One example is employing means to reduce the need for grinding the incoming material. Such means strips the fines from the incoming material and discharges it so there is no need to subject this material to further grinding as it can then become too fine. Thus, only the larger particles need to undergo grinding reduction to a size that is responsive to the output from blower 25 in the first or main circuit that connects into the bustle 21 of the mill 14. The stripping of the fines is accomplished by providing a rotating plate 37 in the mill 14 where the fine particles in the incoming material can be subjected to the flow of the heated gaseous medium and dried while moving out of the mill, while the large particles and hard to grind material drops into the orbit of the grinding means in the mill 14. As the large particles are reduced it becomes responsive to the flow of the gaseous medium upwardly through the mill.

Alternative to the hard to grind material being taken away on conveyor 31, the hard to grind material can be forceably returned by blower 31B through a closed transfer device VC to a closed pipe P connected to the mill below the rotating plate 37 for further reduction in the grinding zone of the mill 14.

Another example of the innovative nature of the disclosure is the ability to add a supplementary agent to the material supplied to the mill 14, which agent which can be mixed into the material by the action of the mill 14. As shown when the material is primarily coal or material having a high percentage of sulfur, it is important to supply a sorbent agent to convert the amount of any sulfur dioxide to a carbon dioxide that is released to the outside at the exhaust stack S. As shown, sorbent material contained in the bin 38 is moved by conveyor 39 is an enclosure 39A to the conduit 12 where it mixes with the material from bin 10. Further mixing occurs in the mill 14 so that a flow of composite material takes place in conduit 15. For coal, a suitable sorbent is limestone and the limestone is delivered in an already ground particulate size that readily mixes with the coal.

The arrangement in FIG. 2 of two cyclones 16 to make up a distribution of fuel from more than a single source, illustrates the possibility that the boiler can be of a size to require several fuel feeders for proper distribution of the fuel supplied to the combustion chamber. In any case, the heat energy generated by the boiler 18 is returned by conduit 20 to the mill 14 to provide the drying heat to condition the mill output for combustion in the boiler.

The apparatus of FIG. 1 for preparing moisture containing fuel material for combustion to produce heat energy which is then applied for lowering the moisture content in the fuel material prior to its combustion, comprises an improved arrangement of a boiler for the combustion of the fuel material to produce drying heat energy, grinding apparatus for preparing the fuel material which is used to produce the heat energy, means to collect the fuel material from the gaseous medium and feeding the boiler while returning the gaseous medium to the grinding apparatus in a first conduit system having a first delivery side connected to the collecting means and a return side and a second conduit system connected through the boiler to the grinding apparatus from the return side of the first conduit system to maintain the first system at a negative pressure.

The control system of FIG. 2 consists of having a main gaseous medium system that goes from the fuel processing mill 14 to the cyclone distribution means 16 responsive to the primary fan 25 and from the primary fan 25 back to the mill 14. Now, in order to pre-strip the material, which will include the limestone which was pre-sized and any fines that are in the feed material, a certain gaseous velocity is needed through mill 14, and this is pre-determined to be approximately 1,600–2,000 feet per minute. At this velocity, fines that are in the feed plus the limestone are conveyed out of the grinding chamber. This is important in that any other type of mill will drop the fines into the grinding chamber thereby producing more extreme fines which is a degradation to the system for the circulating fluidized bed combustor. The reason for this is that the fines will fly up to the cyclone 19 in the circulating fluidized bed combustor 18 (CFB) and will burn in the cyclone instead of back in the fluid bed. It is not desireable to have extreme finds, such as 200 mesh which is 74 micron or 44 micron which is 325 mesh, for that reason. In order to monitor the gas velocity, a measurement device 41 at the outlet of the primary circulating fan 25 will report to the compute 39 that velocity of flow and temperature so that these can be adjusted to keep the motor 42 for primary fan 25 rotating at a speed sufficient so the material from bin 10 is pre-strip of fines to produce the correct product size. Independent of this circuit created by blower 25, the mill 14 has a device 43 which measures the differential pressure (Delta P) in the fluid bed across the mill. This is an indicator of how much grindable material is in the mill. As more material accumulates in the mill, the Delta P will climb. This is normally in the range of six to eight inches of water column. Therefor, the computer 39 would tell the mill motor 44 to adjust its grinding rate to maintain a six-to-eight-inch (Delta P) static pressure. If there were nothing but fines being fed into the system, along with the pre-sized limestone, no course material would drop into the grinding chamber and as a result, the mill motor 44 would slow down so as to keep the Delta P pressure at six to eight inches. As more and more course material or harder to grind material begins to accumulate in the grinding chamber, the mill motor 44 will then be told by the computer 39 to speed up or adjust the speed in the proper direction. Centrifugal force on the journals varies as the square of the RPM, therefore, by a very small RPM change, the force or grinding pressure is controlled. By speeding up the mill motor 44 a very small amount, increased force will adjust the grinding pressure and the mill will grind more rapidly. Therefore, the system does not have to know how much material is being fed into the unit, all it does is keep the Delta P pressure across the grinding zone at a substantial constant reading, between 6 to 8 inches of water column. Now the feed rate and the limestone rate are controlled by the boiler. The feed rate controlled by motor 45 is a function of how many million BTUs are being utilized by the boiler.

While the foregoing description ha identified suitable apparatus for processing moisture bearing fuel material, there results a unique method of operating a boiler with a fuel material containing moisture which prevents normal size reduction and capability of feeding such fuel material into the boiler. The method is unique in that it applies heat energy extracted from a boiler to dry the fuel material externally of the boiler and in a closed system wherein the fuel material undergoes size reduction while being dried and then separated from the resultant heat energy in the form of steam. That steam heat energy and the dried size reduced fuel material are delivered to the boiler so that there is no net energy loss from the system.

What is claimed is:

1. In apparatus for preparing moisture containing fuel material for combustion to produce heat energy and for applying the heat energy from the combustion for lowering the moisture content in the fuel material prior to combustion, the improvement comprising:

(a) boiler means for the combustion of the fuel material to produce heat energy, said boiler means having an exhaust stack for hot gases;

(b) grinding apparatus for preparing the fuel material to produce heat energy;

(c) means for collecting prepared fuel material and for feeding the collected fuel material to said boiler means;

(d) a main gaseous fluid and fuel material conduit system having a first side interconnecting said grinding apparatus and said collecting means for circulating gaseous medium and fuel material to said collecting means and a returning side for the gaseous medium to said grinding apparatus;

f(e) a second conduit system connecting said boiler means and said grinding apparatus to conduct heat energy to said grinding apparatus for lowering the moisture content in the fuel material and to provide the drying heat for said first conduit system, said second conduit system being connected to said boiler means to receive hot gases in advance of the hot gases being exhausted at said exhaust stack; and (f) connecting means between said returning side of said main conduit system and said boiler means for maintaining said main conduit system at a negative pressure to promote the flow of hot gaseous medium from said boiler means to said gringing apparatus.

2. The improvement set forth in claim 1 wherein said main conduit system includes blower means to effect the movement of hot gases and fuel material therein from said grinding apparatus, said grinding apparatus being provided with means for stripping the fine particles in the fuel material responsive to the operation of said blower means, and other means for grinding the non-responsive particles.

3. The improvement set forth in claim 1 wherein said collecting means for the prepared fuel material includes a plurality of devices each connected to said grinding apparatus for substantially evenly distributing the prepared fuel material to said boiler means, said collecting means being cyclone separators.

4. The improvement set forth in claim 1 wherein said grinding apparatus is provided with an outlet for hard to grind fuel material, and means connected to said outlet for beneficiating said hard to grind fuel material to separate from said hard to grind fuel material the granular fuel material, said hard to grind fuel material being recycled back to said grinding apparatus.

* * * * *